United States Patent [19]

Marcus et al.

[11] 4,170,262

[45] Oct. 9, 1979

[54] GRADED PORE SIZE HEAT PIPE WICK

[75] Inventors: Bruce D. Marcus; Donald K. Edwards, both of Los Angeles, Calif.

[73] Assignee: TRW Inc., Redondo Beach, Calif.

[21] Appl. No.: 775,343

[22] Filed: Mar. 7, 1977

Related U.S. Application Data

[63] Continuation of Ser. No. 581,246, May 27, 1975, abandoned.

[51] Int. Cl.[2] ..... F28D 15/00

[52] U.S. Cl. ..... 165/105; 138/40

[58] Field of Search ..... 165/105; 122/366; 138/40

[56] References Cited

U.S. PATENT DOCUMENTS

| | | | |
|---|---|---|---|
| 2,448,261 | 8/1948 | Gaugler | 62/334 |
| 3,414,475 | 12/1968 | Fiebelmann | 165/105 X |
| 3,528,494 | 9/1970 | Levedahl | 165/105 |
| 3,754,594 | 8/1973 | Ferrell | 165/105 X |
| 3,822,743 | 7/1974 | Waters | 165/105 |
| 3,892,273 | 7/1975 | Nelson | 165/105 |
| 3,901,311 | 8/1975 | Kosson et al. | 165/105 |

*Primary Examiner*—Albert W. Davis, Jr.

*Attorney, Agent, or Firm*—Donald R. Nyhagen; John J. Connors

[57] ABSTRACT

Heat pipes containing graded pore non-arterial wicks have substantially improved reliability when compared with those which utilize arteries. Heat pipes having wicks which are optimally graded in pore size in an axial direction, with the pore size decreasing from the condenser to the evaporator end. These graded pore size wicks yield more than twice the capacity of axially uniform pore size wicks having similar geometries.

1 Claim, 3 Drawing Figures

GRADED PORE SIZE HEAT PIPE WICK

This is a continuation of application Ser. No. 581,246, filed 5/27/75 now abandoned.

BACKGROUND OF THE INVENTION

Heat pipes or heat pipe-type devices operate on closed evaporating-condensing cycles for transporting heat from a locale of heat generation to a locale of heat rejection, using a capillary structure or wick for return of the condensate. Such devices generally consist of a closed container which may be of any shape or geometry. Early forms of these devices had the shape of a pipe or tube closed on both ends, and the term "heat pipe" was derived from such devices. The term "heat pipe," as used herein however, refers to a device of any type of geometry designed to function as described above.

In such a heat pipe device, air or other noncondensable gases are usually removed from the internal cavity of the container. All interior surfaces are lined with a capillary structure, such as a wick. The wick is soaked with a fluid which will be in the liquid phase at the normal working temperature of the device. The free space of the cavity then contains the vapor of the fluid at a pressure corresponding to the saturation pressure of the working fluid at the temperature of the device. If at any location, heat is added to the container, the resulting temperature rise will increase the vapor pressure of the working fluid, and evaporation of liquid will take place. The vapor that is formed, being at a higher pressure, will flow towards the colder regions of the container cavity and will condense on the cooler surfaces inside the container wall. Capillary effects will return the liquid condensate to areas of heat addition. Because that heat of evaporation is absorbed by the phase change from liquid to vapor and released when condensation of the vapor takes place, large amounts of heat can be transported with very small temperature gradients from areas of heat addition to areas of heat removal.

Many heat pipe applications require both a high capacity and variable conductance characteristics obtained through the use of noncondensable gas. Generally, high capacities are attained through the use of arterial wick structures. The presence of gas, however, aggravates what are already difficult problems in priming and maintaining a primed state of the arteries, particularly with a high pressure fluid such as ammonia.

Because cavitation is not a problem with low pressure fluids, reliable gas-controlled arterial-wick heat pipes can be made using methanol as the working fluid. These heat pipes exhibit axial heat transport capacities on the order of 5,000–7,000 watt-inches, limited by the relatively poor thermodynamic properties of methanol in combination with constraints associated with the priming mechanism.

To achieve higher capacities, as required in many applications, it is necessary to utilize ammonia as the working fluid. In the case of ammonia, however, its high pressure at relevant temperatures promotes pressure fluctuations in heat pipes sufficient to cause cavitation in the arteries and consequent depriming.

SUMMARY OF THE INVENTION

A uniform pore-size wick has an optimum pore-size equal to twice the gravitational head. A graded variable pore-size wick has infinitely small pore size at the evaporator end. By varying the wick structure so that the pore size decreases from the condenser end to the evaporator end of the heat pipe, it is possible to attain substantially increased heat transfer capacity compared with uniform pore-size (homogeneous) non-arterial wicks. Because wick flow resistance is approximately inversely proportional to the square of the pore size while the capillary pumping pressure varies inversely with the first power of the pore size, an ideal wick would be one in which the pore size at any axial position is as large as possible while still small enough to sustain the local stress on the liquid. This stress is affected by both gravity, in a gravitational field, and flow pressure drops, so that the smallest pore is not necessarily in the evaporator unless the evaporator is also at the highest elevation.

Preliminary analysis of ideally tapered capillary channels indicates that such a wick is capable of providing almost ten times ($\pi^2$) the axial heat transfer capacity possible with wicks having axially uniform pores.

DESCRIPTION OF THE PREFERRED EMBODIMENTS

Figure 1:
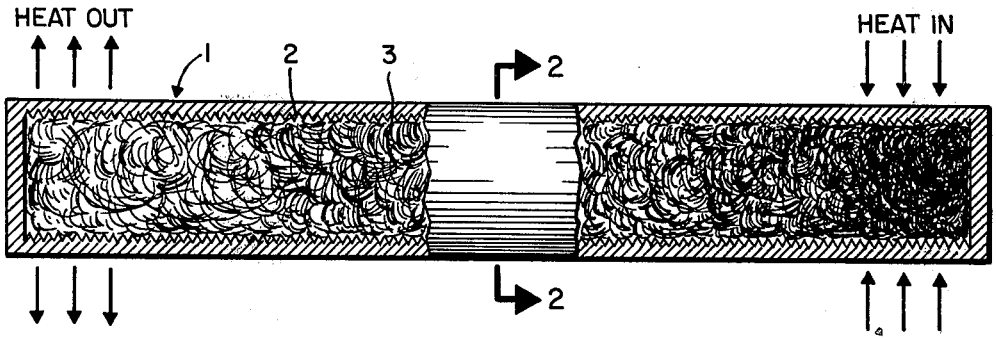
FIG. 1 is a side elevation view partially cut-away to show the position and gradation of wick structure throughout the heat pipe.

Referring to FIG. 1, heat pipe 1 is comprised of circumferential grooves 2 the length of the pipe. Non-arterial wick 3 comprises a porous structure which increases in volume density from the right hand evaporator end or region of the heat pipe, as seen in FIG. 1, which is subjected to a heat input to the left hand condenser end or region where the heat is discharged. Variation of the pore size with a minimum variation of volume density is most desirable.

Figure 2:
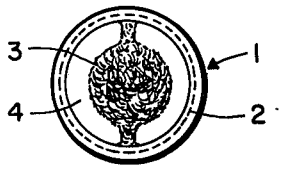
FIG. 2 is a section taken along line 2—2 of FIG. 1.

FIG. 2 is a cross-sectional view taken along line 2—2. This cross-sectional view of heat pipe 1 shows a specific embodiment of a porous capillary structure in the form of a wire mesh wick 3 and a vapor flow space 4. Working fluid in vapor flow space 4 condenses on the interior walls and is carried around the interior of heat pipe 1 by capillary action in grooves 2. The working fluid is transported through wick 3 by capillary action and vaporizes at the heat surface of the wick. The vapor returns to the cooler portion of the heat pipe and condenses again on the walls where the cycle is repeated.

Figure 3:
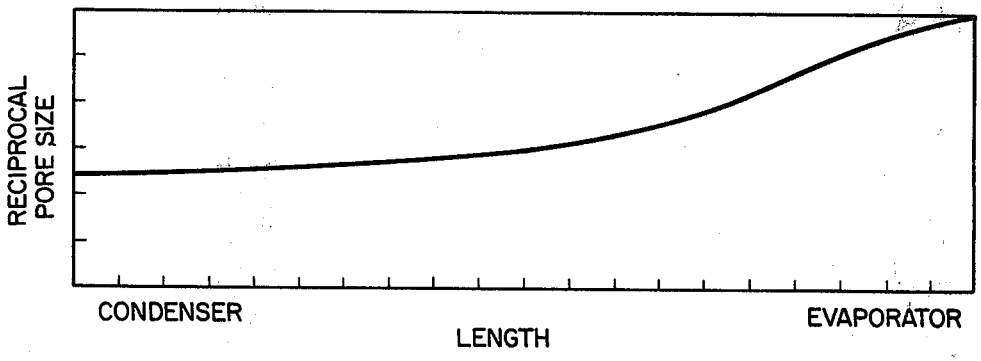
FIG. 3 is a graphical representation of the increase in the reciprocal of the wick pore size per length of heat pipe.

FIG. 3 shows a typical rate of change in the reciprocal of the wick pore size per length of heat pipe. Although the exemplary drawing shows about a $3\frac{1}{2}$ unit change in volume density per 20 units of heat pipe length, the rate of change may be increased or decreased, depending upon the requirements of the performance specifications.

In general, as the pore size of a wick is reduced, the maximum capillary pressure the wick can generate increases, but the permeability decreases. An optimum graded-porosity wick is designed so that, for the maximum heat transfer rate, the porosity of the wick at any point is just low enough to withstand the vapor-liquid pressure difference at that point.

In this regard, it will be recognized that during operation of the heat pipe at any given rate of heat transfer, the vapor pressure in the vapor space 4 diminishes only very slightly from the evaporator region to the condenser region. The liquid pressure in the porous capillary structure or wick 3, on the other hand, diminishes a substantially greater amount from the condenser region to the evaporator region due to the viscous losses created by flow of the liquid phase through the capillary pores of the structure. As a consequence, the liquid pressure in the capillary wick, which substantially equals the vapor pressure at the condenser region, becomes increasingly less than the vapor pressure along the wick toward the evaporator region. The liquid/vapor interfaces in the capillary pores at the surfaces of the wick 3 which are exposed to the vapor space 4, are thus subjected to a vapor/liquid pressure differential which increases along the wick from the condenser region to the evaporator region.

In the absence of any capillary pressure in the wick 3, this pressure differential would result in explusion of the liquid from the wick by the vapor, thus terminating operation of the heat pipe. To prevent this, the capillary pores in the wick must be so sized that at all points along the wick, the capillary-pressure limit of the wick plus the liquid pressure in the wick at least equals and preferably slightly exceeds the vapor pressure in the vapor space 4 over the entire operating range of the heat pipe, and most importantly at its maximum rate of heat transfer. That is to say, the wick pores must be sized to compensate for the vapor/liquid pressure differential across the surface pores when the heat pipe is operating at its maximum rate of heat transfer.

According to the present invention, this is accomplished by grading the wick pore size in a manner such that at each cross section along the wick, the pores are just small enough to provide a local capillary-pressure limit slightly greater than the local vapor/liquid pressure differential (i.e., vapor pressure minus liquid pressure) at that cross section during heat pipe operation at its maximum rate of heat transfer. Since this pressure differential increases from substantially zero at the condenser region to a maximum at the evaporator region, the pore size is graded to diminish from the condenser region to the evaporator region. This grading of the pore size along the wick thus permits compensation, by capillary pressure, for the increasing vapor/liquid pressure differential along the wick with the largest possible pore size at every cross section. Since the resistance to liquid flow decreases with increasing pore size, such a wick has minimum resistance to liquid flow through the wick.

In contrast, for a homogeneous wick with no porosity variation, the porosity is unnecessarily lower than required to support the vapor-liquid pressure difference everywhere except at the end of the evaporator. The result is an unnecessarily high flow resistance and low maximum heat-transfer rate. An approximate formula that predicts the ratio R of maximum zero-g heat-transfer rate for an optimized graded-porosity wick with porosity varying from $\phi_i$ to $\phi_f$ to that for a homogeneous wick of porosity $\phi_h$ is given by the expression $R=1/\phi_h \ln(1-\phi_f/1-\phi_i)$; where $\phi_f<\phi_i$ and $\phi_{itb} \gtrsim 1.0$.

Heat pipe wicks according to the present invention are made of wire mesh fabricated by the Cal-Metex Corporation, Inglewood, California. The wire metal may be any of the typical structural metals, such as copper, stainless steel, aluminum, or alloys thereof to name a few of the more common examples. The wire mesh can be fabricated by any of several techniques. for example, by knitting or felting round wire or stacking corrugated flat ribbon. Other techniques will become apparent to those skilled in the art. The amount of mesh material per unit length is controlled so that the wick porosity conforms to a predetermined variation. Typically, a wick could consist of 0.008-in. diameter fibers with a porosity that varies from 0.87 at the condenser to 0.50 at the evaporator end. Thus, if $\phi_h=\phi_f$ so that the homogeneous and graded porosity wicks have the same maximum capillary pressure at the evaporator end, when $\phi_f=0.50$ and $\phi_i=0.87$, the performance ratio is 2.7. Performance for a typical homogeneous wick using ammonia at 70° F. is 4200 watt-in., while that for an equal cross-sectional area graded-porosity wick is 11,300 watt-in.

We claim:

1. A heat pipe comprising:

a hermetic casing having interior evaporator and condenser regions and a vapor flow space communicating said regions, a heat transfer fluid within said casing for transporting heat from said evaporator region to said condenser region by a closed thermodynamic cycle involving evaporation of said fluid to the vapor phase in said evaporator region in response to heat input to the latter region, flow of the vapor phase through said flow space to and condensation of the vapor phase to the liquid phase within said condenser region in response to heat rejection from the latter region, and return of the liquid phase to said evaporator region, a porous capillary structure for conducting said liquid phase from said condenser region to said evaporator region by capillary action, said porous structure containing a myriad of capillary pores extending throughout the interior of said structure for conducting said liquid phase from said condenser region to said evaporator region and opening through the surface of said structure to said vapor space, whereby pores at said structure surface contain liquid/vapor interfaces, and the pore size of said porous structure being graded to diminish along said structure from said condenser region to said evaporator region in a manner such that at any given cross section of said structure transverse to the direction of liquid flow through said structure from said condenser region to said evaporator region, said pores are relatively uniformly sized to provide a local capillary-pressure limit at said cross section at least equaling the difference between the liquid pressure in the structure at said cross section and the vapor pressure in said vapor space during heat pipe operation at a given maximum rate of heat transfer.

* * * * *